United States Patent [19]

Studtmann

[11] 4,398,385

[45] Aug. 16, 1983

[54] PIVOTABLE SPINDLE MOUNTING

[75] Inventor: Rainer Studtmann, Ingolstadt, Fed. Rep. of Germany

[73] Assignee: Schubert & Salzer, Ingolstadt, Fed. Rep. of Germany

[21] Appl. No.: 314,371

[22] Filed: Oct. 23, 1981

[30] Foreign Application Priority Data

Oct. 24, 1980 [DE] Fed. Rep. of Germany ..... 3040124

[51] Int. Cl.[3] ..... D02G 3/28; D01H 1/241

[52] U.S. Cl. ..... 57/18; 57/89

[58] Field of Search ..... 57/3, 6, 9, 18, 19, 57/88, 89, 270, 273

[56] References Cited

U.S. PATENT DOCUMENTS

| | | | |
|---|---|---|---|
| 1,896,505 | 2/1933 | Bartholomew | 57/89 |
| 2,246,473 | 6/1941 | Stahlecker | 57/89 |
| 2,252,037 | 8/1941 | Schaum . | |
| 3,640,144 | 2/1972 | Eckholt | 57/89 X |
| 3,927,515 | 12/1975 | Northup et al. | 57/18 |

FOREIGN PATENT DOCUMENTS 789626 1/1958 United Kingdom .

*Primary Examiner*—Donald Watkins
*Attorney, Agent, or Firm*—Julian W. Dority

[57] ABSTRACT

A pivotable spindle mounting provided on a machine frame such as a wrap spinning machine that has a spindle mounted on a pivotable arm. The pivotable arm is mounted on a support bolt. A stud is carried on the support bolt and extends through a slide provided in a bushing that is rotated, the pivotable arm with the spindle thereon is rotated beneath a cover and upon a counter-force engaging the pivotable arm, the pivotable motion of the arm and spindle is converted to a lifting motion wherein the top of the spindle is positioned closely adjacent an opening in a cover.

9 Claims, 4 Drawing Figures

PIVOTABLE SPINDLE MOUNTING

BACKGROUND OF THE INVENTION

The present invention relates to a pivotable spindle mounting, in particular, for a wrap spinning apparatus, wherein a pivot arm holding the spindle is carried on a support bolt.

It is known to attach a spindle to a pivot arm which is mounted on a support bolt connected, fast to rotation, to the machine frame and which is rotatable about the support bolt (DE-AS No. 1,218,915, DE-PS No. 1,237,261, GB-PS No. 630,342, GB-PS No. 831,549). Such an arrangement makes it possible to pivot each spindle individually into the horizontal plane and thus to bring it into and out of engagement with a tangential belt. A spindle mounting is furthermore known in which the spindle, during its motion out of the operating position into the inoperative position, is additionally given a tilting motion as well as the horizontal pivoting motion, in order to be able to doff the bobbin from the spindle without hindrance from a stationary yarn guide (U.S. Pat. No. 2,252,037).

These known spindle mountings are, however, restricted to machines in which no stationary machine parts lie in the path on which the spindle pivots. When, for example, as provided in a known wrap spinning apparatus, the tip of the spindle porjects in the operating position into the wedge-shaped gap formed by a delivery roll pair, the front delivery roll prevents the pivoting of the spindle. In order to be able to change a bobbin located on the spindle in such an apparatus, it was therefore proposed to first move the spindle axially out of the region of the delivery rolls and then to tilt it forward, towards the service side, away from the tangential belt (U.S. Pat. No. 3,927,515). For this purpose, the spindle is arranged on a carrier which is mounted to be displaceable in the vertical direction and also tiltable.

Hence, it is in fact possible to bring the spindle into an inoperative position in which a bobbin change can take place. The apparatus is, however, costly and unreliable, since the carriers can tilt in its guides. A further disadvantage is that the carrier is supported, in the operating position of the spindle, by a screw arranged outside the dead center. The screw must, therefore, move away over the dead center on lowering or raising the spindle, so that the spindle tip, out above its operation position, approaches the nip line of the delivery roll pair. The free end of the spindle can hence not be arranged, as required, in the immediate neighborhood of the nip line.

The object of the present invention is to avoid the disadvantages of the known apparatuses and to provide a pivotable spindle mounting which, with simple construction, operational reliability, and easy servicing, can also be used for machines on which the free spindle end projects into stationary components.

SUMMARY OF THE INVENTION

In accordance with the present invention, there is provided a pivotal spindle mount that includes a spindle carried on a pivot arm. The pivot arm is, in turn, carried on a support bolt. The support bolt is rotatably arranged on a machine frame and a pivoting motion of spindle results from rotary motion of the pivot arm and, on the action of a counter-force, this pivoting motion can be converted into a lifting motion of the spindle.

The lifting motion is caused by a stop which produces the counter-force and which is associated with a pivot arm. In an easily adjustable embodiment, the support bolt has a stud which rides in a slide provided in a mounting bushing of the pivot arm so as to lift the spindle. Further arrangements envisage that the support bolt and the pivot arm mounting bushing are constructed as a threaded pair, or that the pivot arm mounting bushing is divided in two parts by an oblique cut and the lower part is connected, fast to rotation, to the support bolt.

By means of the attachment to the support bolt of a lever with a belt lifting roller, the spindle can be moved in a vertical direction when the drive belt is lifted off, so that it also becomes stationary in the operating position and for piercing-up does not need to be additionally braked. In order to accelerate bringing the spindle to rest, a brake jaw for the spindle is arranged on the lever. A further acceleration of the stopping process, and simultaneously with fixing of the spindle in the inoperative position, is effected by the association of a second stationary brake jaw with the brake jaw. The spindle is clamped between the two brake jaws.

In an apparatus in which the bobbin set on the spindle is surrounded by a housing and a cover forming part of the housing, servicing and piercing-up are facilitated in that the cover is arranged to be stationary and the lifting motion of the spindle takes place when the spindle is located beneath a bore in the cover.

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein:

DESCRIPTION OF THE PREFERRED EMBODIMENT

The invention is described below with reference to a wrap spinning apparatus, for which it is particularly provided. However, it can also be used on other textile machines.

Figure 1:
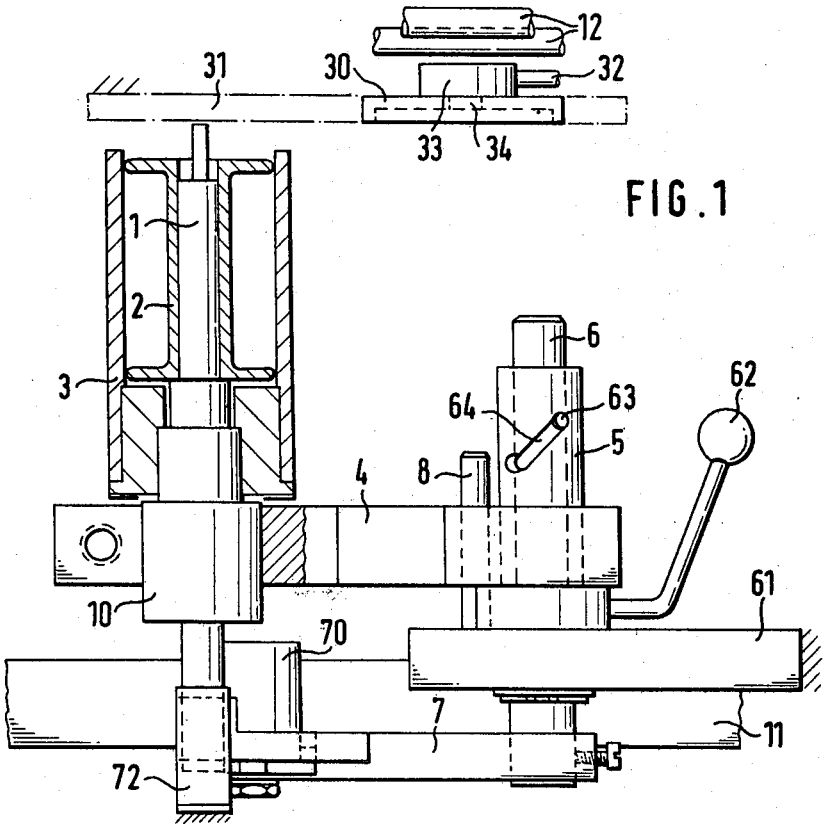
FIG. 1 is an elevational view partially in section showing a wrap spinning apparatus with a spindle mounted according to the invention, in the stopped position.

The wrap spinning apparatus contains a spindle 1, constructed as a hollow spindle, rotatably mounted in a spindle bearing 10 held by a support arm 4, and driven by a tangential belt 11 when operating (FIG. 1). A flanged bobbin 2 with a binder thread (not shown) is placed on the spindle 1; the thread is passed, together with a spinning fiber bundle delivered by a delivery roll pair 12, through the hollow shaft of the spindle 1 during wrap spinning, and hence is wound around the spinning fiber bundle.

The flanged bobbin 2 is concentrically surrounded by a housing 3, which is arranged stationary on the spindle mounting 10. The spindle 1 projects out of the housing 3. In the operating position—FIG. 1 shows the apparatus out of action—the housing 3 is closed by a cover 30 which is arranged stationary in a rail fastened to the machine frame. As compared to known apparatuses in which the cover is set on the housing 3 and must be taken off manually, for example, for changing the flanged bobbin 2, this arrangement of the cover being fixed to the frame leads to simplification of servicing and to a stable mounting of the cover, which can also be constructed sectionally. Apart from this, a suction duct 32 required for piercing-up can be rigidly connected to the cover 30, or else open into a chamber 33 set on the cover. The cover 30 is appropriately provided with a projecting edge which overlaps the upper edge of the housing 3 in the operating position and thus on the one hand improves the sealing of the interior of the housing and on the other hand centers the housing 3. A bore 34 in the cover 30 makes it possible to push the part of the spindle 1 projecting out of the housing 3 through the cover, so that the inlet opening of the spindle 1 is located in the chamber 33 and hence in the neighborhood of the suction duct 32.

The pivot arm 4 holding the spindle 1 is mounted by means of a mounting bushing 5 on a support bolt 6, which is arranged rotatably in a part 61 of the machine frame and can be rotated by means of a handle 62. A stud 63 of the support bolt 6 engages into a lifting slide 64 provided in the mounting bushing 5. The slide includes a slotted hole running obliquely of the long axis of the mounting bushing which terminates in a horizontal plane at its lower end. Further, a lever 7 is mounted on the rotatably mounted support bolt 6, with a belt lifting roller 70 for the tangential belt 11 arranged at its free end. The belt lifting roller 70 is appropriately mounted displaceably in a slotted hole. A brake jaw 71 on the lever accelerates bringing the spindle 1 to rest, which can be still further shortened by a second, stationary brake jaw 72 positioned at the end of the pivoting path of the spindle when moved into the inoperative position. A stop 8 is associated to the pivot arm 4 carrying the spindle 1 and limits the pivoting motion of the pivot arm 4 on pivoting the spindle 1 into the operating position at the point at which the spindle is located exactly underneath the bore 34 in the cover 30. This stop 8, acting as a counter-force, can also if necessary be replaced by other means, for example, by magnetic means.

Figure 2:
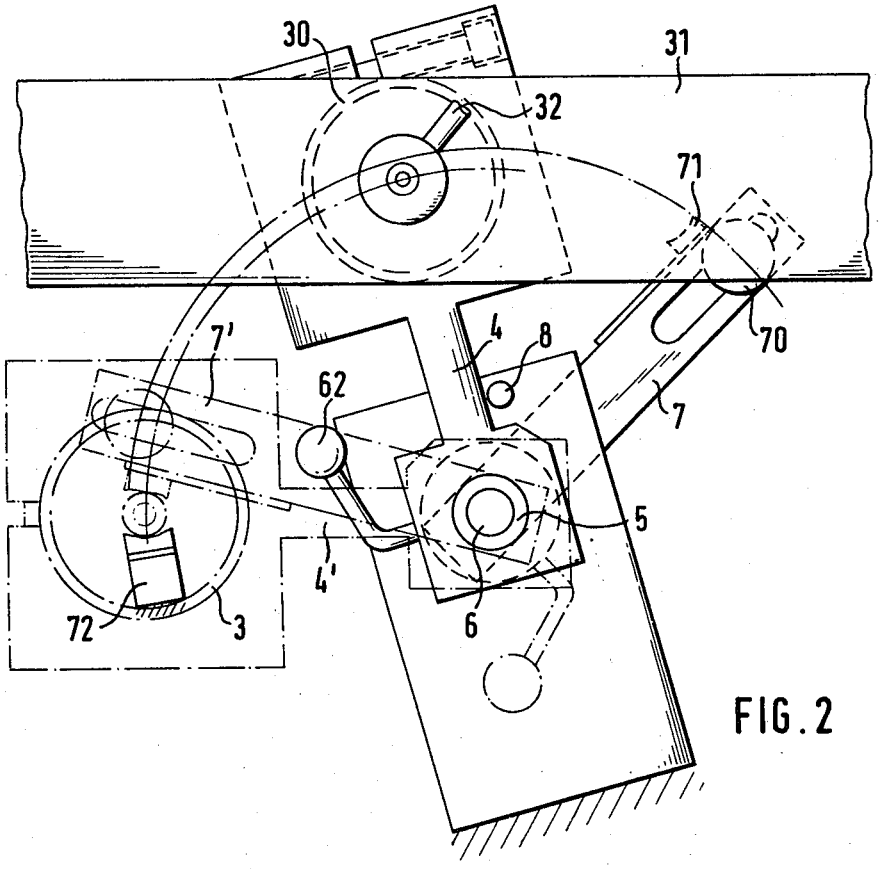
FIG. 2 is a plan view of the apparatus of FIG. 1 showing the spindle in a stopped position and in an operating position.

When the spindle shown in the stopped position in FIG. 1 and by dot-dash lines in FIG. 2 is to be brought into the operating position, the support bolt 6 is rotated by means of the handle 62 and the pivot arm 4 is hence pivoted in the horizontal plane out of its position 4' in the direction towards the tangential belt 11, until it strikes against the stop 8 (FIG. 2). Simultaneously with the pivot arm 4, the lever 7, located in the position 7', is also pivoted horizontally by the rotation of the support bolt 6; the belt lifting roller 70 arranged on the lever 7 and lying, as seen in the direction towards the tangential belt, behind the spindle or, respectively, its drive whorl, pushes the belt away from the spindle 1 and its drive is prevented.

The pivoting motion of the pivot arm 4 and also, for the time being, of the lever 7 also, is ended when the pivot arm 4 strikes against the stop 8 and the spindle 1 is thus located in a fixed position beneath the bore 34 in the cover 30. On further rotation of the support bolt 6, this rotary motion is converted into a lifting motion of the pivot arm 4 and of the spindle 1 held by it, in that the stud 63 is moved in the lifting slide 64 of the mounting bushing 5 in the direction towards the pivot arm 4. During the lifting motion, the lever 7 in fact pivots with the belt lifting roller away from the spindle 1, but only so far, depending on the arrangement, that the tangential belt 11 remains lifted from the spindle whorl.

By means of the lifting motion, the spindle tip arrives, through the bore 34 in the cover 30, in the chamber 33 and the housing 3 is pressed into the stationary cover 30. The housing is thus closed and is placed under reduced pressure produced by the suction duct 32 opening into the chamber. The apparatus is now prepared by piecing-up, which takes place conventionally, in that the spinning fiber bundle delivered by the delivery roll pair 12, the end of the binder thread wound on the flanged bobbin 2, and the end of the finished wrap yarn, wound on a bobbin which is not shown, are collected together in the suction duct 32 and these three components are then connected together by setting the spindle 1 in operation.

For setting the spindle 1 in operation, the support bolt 6 is rotated still further, so that the stud 63 now only advances further in the horizontal slotted hole of the slide 64 and the lever 7 pivots away from the tangential belt 11. The belt lifting roller 70 releases the belt, which comes into abutment with the spindle 1 and drives it.

When the spindle 1 is brought to rest by turning the support bolt 6 with its stud 63 back into the position shown in FIG. 1, the motion processes described above run in the opposite direction: the tangential belt 11 is lifted from the spindle 1 and then the pivot arm 4 with the spindle 1 is lowered until the spindle tip is located beneath the edge of the cover 30. Since the lever 7 pivots further in the direction towards the spindle 1 during the downward stroke due to the rotation of the support bolt 6, the brake jaw 71 comes into contact with the spindle 1 and remains pressed against the spindle 1 during the subsequent horizontal pivoting motion of the pivot arm 4. At the end of the pivoting path, the spindle 1 strikes against the stationary brake jaw 72 and is clamped fast between the two brake jaws 71 and 72.

Figure 3:
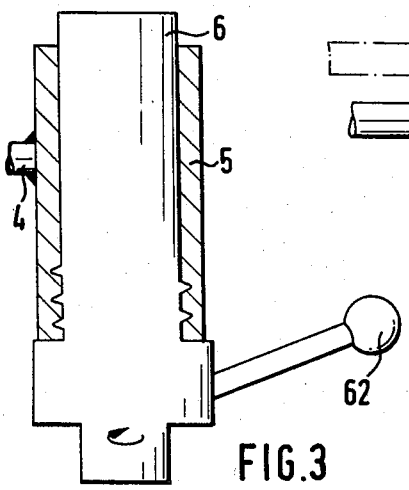
FIGS. 3 and 4 are elevational views partially in section showing modified forms of the invention.
Figure 4:
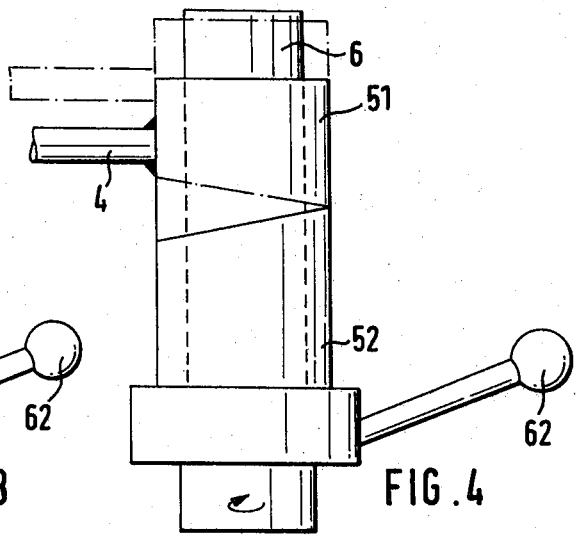

FIGS. 3 and 4 show two further possibilities of converting the rotary motion of the support bolt 6 into a lifting motion of the spindle 1. In FIG. 3, the mounting bushing 5 and the support bolt 6 are constructed as a threaded pair, the pitch of the thread being chosen to be relatively coarse in order to obtain a large stroke from the limited rotary motion of the support bolt. According to FIG. 4, the mounting bushing 5 is divided into two parts 51 and 52 by a cut running obliquely of its long axis; of these, part 51 carries the pivot arm 4 and part 52 is connected, fast to rotation, to the mounting of the handle 62 for rotation of the support bolt 6.

What is claimed:

1. A pivotal spindle mounting, provided on a machine frame, in particular for a wrap spinning apparatus having a spindle mounted on a pivot arm, said pivot arm being mounted on a support bolt, the improvement comprising:

means for rotatably mounting said support bolt on said machine frame;

means for rotating said support bolt providing a pivotal motion to said pivot arm and spindle and applying a counter-force to the pivotal motion converting said pivotal motion of said spindle into a lifting motion.

2. The pivotal spindle mounting as set forth in claim 1 further comprising:

said means for applying a counter-force including, (i) a stop carried in the path of said pivot arm after said pivot arm is rotated a predetermined distance.

3. The pivotal spindle mounting as set forth in claim 1 further comprising:

a stud carried on said support bolt;

a bushing attached to by said pivot arm is concentrically carried on said support bolt;

a slide provided in said bushing through which said stud extends for causing said lifting motion of said pivot arm and spindle when said counter-force is applied.

4. The pivotal spindle mounting as set forth in claim 1 further comprising:

a mounting bushing threadably attaching said pivotal arm to said support bolt for causing said lifting motion of said pivot arm and spindle when said counter-force is applied.

5. The pivotal spindle mounting as set forth in claim 1 further comprising:

a mounting bushing connecting said pivotal arm to said support bolt; and said mounting bushing being divided by an oblique cut into an upper and lower part with said lower part being fixed to said support bolt and the upper part being fixed to said pivotal arm.

6. A pivotal spindle mounting as set forth in claim 1 further comprising:

a belt for driving said spindle; and a lever having a belt lifting roller provided thereon being attached to said support bolt.

7. The pivotal spindle as set forth in claim 6 further comprising:

a brake jaw carried on said lever for engaging said spindle.

8. The spindle mounting as set forth in claim 1 further comprising a second stationary brake jaw being associated with said brake jaw for clamping said spindle threbetween when said lever is in a predetermined position.

9. The apparatus set forth in claim 1 further comprising:

a bobbin carried on said spindle;

a housing surrounding said bobbin including a cover;

said cover being positioned directly above said spindle when said spindle is in the location where the pivotal motion of said spindle is converted to a lifting motion.

* * * * *